US010781632B2

(12) United States Patent
Campagna

(10) Patent No.: US 10,781,632 B2
(45) Date of Patent: Sep. 22, 2020

(54) SHADE BRACKET AND DIVERTER

(71) Applicant: Crestron Electronics, Inc., Rockleigh, NJ (US)

(72) Inventor: Michael Campagna, Woodcliff Lake, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 373 days.

(21) Appl. No.: 15/896,163

(22) Filed: Feb. 14, 2018

(65) Prior Publication Data

US 2019/0249488 A1 Aug. 15, 2019

(51) Int. Cl.

| | |
|---|---|
| ***E06B 9/50*** | (2006.01) |
| ***E06B 9/48*** | (2006.01) |
| ***E06B 9/58*** | (2006.01) |

(52) U.S. Cl.

CPC ..... *E06B 9/48* (2013.01); *E06B 9/50* (2013.01); *E06B 9/58* (2013.01)

(58) Field of Classification Search

CPC ..... E06B 9/40; E06B 9/42; E06B 9/44; E06B 9/48; E06B 9/50; E06B 9/58; E06B 9/174; E06B 2009/1716; A47H 1/13

USPC ..... 160/368.1, 323.1, 324, 325, 326; 248/266, 267, 268

See application file for complete search history.

(56) References Cited

U.S. PATENT DOCUMENTS

| | | | | | |
|---|---|---|---|---|---|
| 152,256 | A * | 6/1874 | Stowe | E06B 9/50 | 248/266 |
| 187,868 | A * | 2/1877 | Knapp | E06B 9/78 | 160/300 |
| 517,952 | A * | 4/1894 | Lambert | A47H 1/13 | 248/257 |
| 661,876 | A | 11/1900 | Jacobus | | |
| 978,246 | A * | 12/1910 | Weiher | E06B 9/50 | 248/268 |
| 1,052,049 | A * | 2/1913 | Gasse | E06B 9/50 | 248/266 |
| 1,237,656 | A * | 8/1917 | Kotzich | E06B 9/13 | 160/268.1 |
| 1,383,975 | A * | 7/1921 | Booth | E06B 9/50 | 248/254 |
| 1,650,744 | A * | 11/1927 | Smith | A47H 1/13 | 248/268 |
| 1,706,261 | A * | 3/1929 | Strongson | E06B 9/58 | 160/293.1 |
| 1,838,320 | A * | 12/1931 | Moore | E06B 9/50 | 248/254 |

(Continued)

*Primary Examiner* — Johnnie A. Shablack
(74) *Attorney, Agent, or Firm* — Crestron Electronics, Inc.

(57) ABSTRACT

A pair of shade brackets and a diverter are provided for diverting a shade material of a roller shade to a fixed drop down position. The pair of mounting brackets are adapted to secure to a structure and retain the roller shade therebetween. Each mounting bracket comprises a diverter retaining portion. The diverter comprises a diverter roller and a pair of bearings disposed on two opposite ends of the diverter roller. The diverter is removably retained between the pair of mounting brackets such that each bearing is engaged by a respective diverter retaining portion and the diverter roller is adapted to freely rotate via the bearings. As the shade material is raised or lowered, the diverter roller rolls on the shade material via the bearings.

15 Claims, 6 Drawing Sheets

(56) References Cited

U.S. PATENT DOCUMENTS 1,882,623 A * 10/1932 Kasper ..... E06B 9/50 160/299
1,968,428 A * 7/1934 Schmidt ..... E06B 9/50 160/268.1
2,029,675 A * 2/1936 Schlamp ..... E06B 9/78 160/121.1
2,049,471 A * 8/1936 Reilly ..... E06B 9/50 160/122
2,257,014 A * 9/1941 Jacobson ..... E06B 9/50 248/266
2,396,266 A * 3/1946 Jeffs ..... E06B 9/50 248/268
2,525,513 A * 10/1950 Barr ..... E06B 9/50 248/267
2,725,098 A * 11/1955 Kirkham ..... E06B 9/50 160/41
3,110,343 A 11/1963 Guffan
3,421,568 A * 1/1969 Youngs ..... E06B 9/174 160/310
3,713,569 A * 1/1973 Dashnier ..... A47K 10/38 225/21
3,900,063 A * 8/1975 Roller ..... E06B 9/17 160/310
3,912,187 A * 10/1975 Woelky ..... B65H 16/005 242/370
4,096,904 A * 6/1978 Donofrio ..... E06B 9/90 160/299
4,122,559 A * 10/1978 Kelly ..... A47K 3/38 160/11
4,126,174 A * 11/1978 Moriarty ..... E06B 9/44 160/266
4,187,896 A 2/1980 Shore
4,226,396 A * 10/1980 Bowers ..... A47H 1/102 248/254
4,418,739 A * 12/1983 Woolnough ..... E06B 9/40 160/120
4,453,584 A 6/1984 Steele
4,610,292 A * 9/1986 Hausmann ..... E06B 9/24 160/120
5,054,676 A * 10/1991 Ban ..... A47K 10/38 225/42
5,123,474 A * 6/1992 Smith ..... E06B 9/13 160/273.1
5,230,494 A * 7/1993 Adams ..... A47H 1/10 160/903
5,392,887 A * 2/1995 Nisenson ..... E06B 9/42 160/297
5,445,209 A * 8/1995 Lichy ..... E06B 9/13 160/273.1
5,655,587 A * 8/1997 Kraler ..... E06B 9/174 160/31
5,857,653 A * 1/1999 Dujlovich ..... E06B 9/42 160/294
6,138,740 A * 10/2000 Chou ..... E06B 9/36 160/298
6,201,364 B1 * 3/2001 Will ..... E06B 9/174 160/1
6,257,305 B1 * 7/2001 Mullet ..... E06B 9/42 160/133
6,341,639 B1 * 1/2002 Mullet ..... E06B 9/40 160/264
6,651,720 B1 11/2003 DiSilvestro et al.
6,712,115 B2 3/2004 Judkins
6,873,461 B1 * 3/2005 McPherson, Jr. ..... E06B 9/50 160/23.1
7,017,644 B1 * 3/2006 Kraeutler ..... E06B 9/84 160/271
D557,115 S 12/2007 Zakowski
7,677,294 B2 * 3/2010 Bohlen ..... E06B 9/50 160/323.1
8,069,898 B1 12/2011 Mullet et al.
8,584,728 B2 11/2013 Truett et al.
8,960,260 B2 * 2/2015 Anderson ..... E06B 9/72 160/310
D732,932 S 6/2015 Ng et al.
D740,589 S 10/2015 Ng
9,210,784 B2 12/2015 Antoniazzi
9,260,914 B2 * 2/2016 Certain ..... E06B 9/26
9,328,555 B2 * 5/2016 Faller ..... E06B 9/26
10,392,861 B2 * 8/2019 Geiger ..... E06B 9/42
2008/0053628 A1 * 3/2008 Anderson ..... E06B 9/264 160/238
2014/0166218 A1 * 6/2014 Ng ..... E06B 9/42 160/120
2014/0299729 A1 * 10/2014 Wills ..... E06B 9/50 248/254
2015/0059991 A1 * 3/2015 Kwak ..... E06B 9/262 160/113
2015/0300084 A1 * 10/2015 Schonerwald ..... E06B 9/68 160/133
2015/0345216 A1 * 12/2015 Feldstein ..... E06B 9/50 160/310
2016/0319595 A1 * 11/2016 Dwarka ..... E06B 9/42
2018/0117375 A1 * 5/2018 Gomaa ..... E06B 9/17
2018/0209214 A1 * 7/2018 Geiger ..... E06B 9/50
2018/0313147 A1 * 11/2018 Krantz-Lilienthal ..... E06B 9/78
2018/0347274 A1 * 12/2018 Berman ..... E06B 9/50
2019/0257149 A1 * 8/2019 Lei ..... E06B 9/60
2019/0316414 A1 * 10/2019 Zhang ..... E06B 9/50
2019/0352963 A1 * 11/2019 Jang ..... E06B 9/90
2020/0048960 A1 * 2/2020 Dwarka ..... E06B 9/44

* cited by examiner

SHADE BRACKET AND DIVERTER

BACKGROUND OF THE INVENTION

Technical Field

Aspects of the embodiments relate to shades, and more particularly to systems, methods, and modes for a shade bracket and diverter.

Background Art

Roller shades are effective in screening windows, doors, or the like, to achieve privacy and thermal effects. A roller shade typically includes a rectangular shade material, such as fabric, attached at its top end to a cylindrical rotating tube, called a roller tube, and at an opposite bottom end to a hem bar. The shade material is wrapped around the roller tube. The roller tube is rotated, either manually or via an electric motor, in a first direction to roll down the shade material to cover a window and in a second direction to roll up the shade material to uncover the window.

In a typical installation of a roller shade, the shade material drops down tangential from the back of the roller tube, closest to the window. In some configurations, a fascia is mounted over the roller tube to provide a means to hide most of the shade hardware, leaving an opening for the shade material to drop down. In another configuration, the roller shade may be installed in an architectural pocket in the ceiling. As the shade material unrolls off the tube, the diameter of the shade material on the roller gets smaller, causing lateral movement of the shade material toward the room. As such, the drop down position of the shade material is continuously displaced. Likewise, in a reverse roll configuration, where the fabric comes off the front of the roll, closest the room, as the shade material unrolls off the tube, the shade material moves away from the room. A reverse roll is commonly used when the window has hardware that protrudes into the path of the lowering shade fabric.

However, in some installations it is not desirable for the shade material to laterally travel as it is unrolled from the tube. For example, where a ceiling pocket layout is narrow, containing a narrow opening into which the shade hem bar is received, the ham bar may potentially hit something and get stuck inside the pocket. Additionally, the shade material may rub against the pocket opening causing fraying or damage to the shade material. In such circumstances, the shade material must be diverted to minimize lateral displacement. For example, the shade material may need to drop down directly under the center of the roller and through a 1.5 in opening in the pocket.

Accordingly, a need has arisen for systems, methods, and modes for a shade bracket and diverter.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a shade bracket and diverter that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a diverter assembly is provided for a roller shade comprising a shade material. The diverter assembly comprises a pair of mounting brackets and a diverter. The pair of mounting brackets are adapted to secure to a structure and retain the roller shade therebetween. Each mounting bracket comprises a diverter retaining portion. The diverter comprises a diverter roller and a pair of bearings disposed on two opposite ends of the diverter roller. The diverter is removably retained between the pair of mounting brackets such that each bearing is engaged by a respective diverter retaining portion and the diverter roller is adapted to freely rotate via the bearings. The diverter roller is adapted to divert the shade material to a fixed drop down position.

According to an embodiment, each mounting bracket comprises a structural mounting portion adapted to secure the mounting bracket to the structure. According to another embodiment, each mounting bracket comprises a shade mounting portion adapted to couple one end of the roller shade to the mounting bracket. The diverter retaining portion may extend along a first plane, while the shade mounting portion may extend along a second plane, which is offset from the first plane such that the diverter retaining portion protrudes farther than the shade mounting portion. The diverter retaining portion may be disposed directly below the shade mounting portion to substantially center the fixed drop down position of the shade material with a center of the roller shade.

According to an embodiment, the diverter retaining portion may comprise a vertical side wall as well as a bottom wall and a rear wall laterally extending from the vertical side wall. According to one embodiment, the bottom wall may be disposed at a right angle with respect to the rear wall. According to another embodiment, the bottom wall may be declined towards the rear wall to further assist the diverter to be retained by the diverter retaining portion. According to one embodiment, the bottom wall and the rear wall may be interconnected. According to an alternative embodiment, the bottom wall and the rear wall may be separated forming a pair of retaining arms.

According to an embodiment, each bearing may be removably engaged by the respective diverter retaining portion by resting between the respective bottom wall and rear wall of the respective diverter retaining portion. Each bearing may comprise an outer race and an inner race rotatably movable with respect to the outer race, wherein the outer race is engaged between the respective bottom wall and rear wall of the respective diverter retaining portion, and wherein the inner race is operably attached to the diverter roller. According to an embodiment, the diverter may further comprise a pair of bearing hubs attached to the opposite ends of the diverter roller and each adapted to retain one of the bearings. Each bearing hub may comprise a plug sized to be press fitted in a bore longitudinally extending within the diverter roller. Each bearing hub may further comprise a shoulder adapted to receive one of the bearings thereon. Each bearing hub may also comprise a threaded bore adapted to receive a screw therein, wherein the bearing is retained on the shoulder via a head of the screw.

According to an embodiment, each diverter retaining portion may comprise an opening extending therethrough sized to receive the screw head to align the diverter with the diverter retaining portion. According to another embodiment, the diverter may further comprise a pair of biased pins extending from the two opposite ends of the diverter roller, wherein each diverter retaining portion comprises an opening extending therethrough sized to receive the biased pins to align the diverter with the diverter retaining portion.

According to an embodiment, as the shade material is raised or lowered, the shade material rotates the diverter roller with respect to the diverter retaining portion via the bearings such that the diverter roller rolls on the shade material.

According to another aspect of the embodiments, a diverter assembly is provided for a roller shade secured to a structure and comprising a shade material. The diverter assembly comprises a pair of mounting brackets adapted to secure to a structure and a diverter. Each mounting bracket comprises a vertical side wall as well as a bottom wall and a rear wall laterally extending from the vertical side wall. The diverter comprises a diverter roller and a pair of bearings disposed on two opposite ends of the diverter roller. The diverter is removably retained between the pair of mounting brackets such that each bearing is engaged between the bottom wall and the rear wall of a respective diverter retaining portion. The diverter roller is adapted to divert the shade material to a fixed drop down position, wherein as the shade material is raised or lowered the diverter roller rolls on the shade material via the bearings.

According to a further aspect of the embodiments, a method is provided for diverting a shade material of a roller shade to a fixed drop down position. The method comprises the steps of: securing a pair of mounting brackets to a surface of a structure; installing the roller shade between the pair of mounting brackets, wherein each mounting bracket comprises a vertical side wall as well as a bottom and a rear wall laterally extending from the vertical side wall; inserting a diverter between the mounting brackets, wherein the diverter comprises a diverter roller and a pair of bearings disposed on two opposite ends of the diverter roller; resting each bearing of the diverter between the bottom wall and the rear wall of a respective mounting bracket; and resting the shade material on the diverter roller, wherein as the shade material is raised or lowered the diverter roller rolls on the shade material via the bearings.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
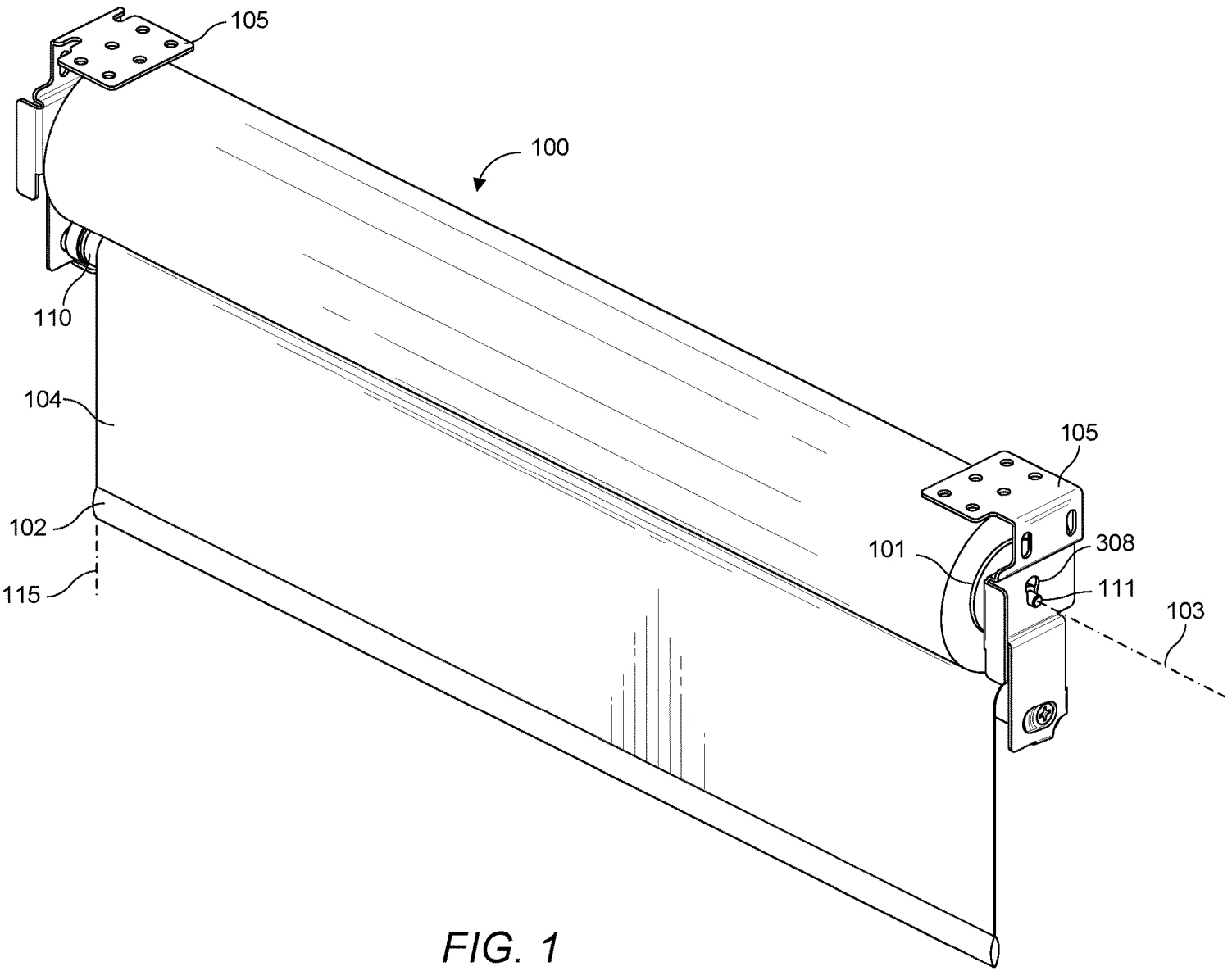

FIG. 1 illustrates a front perspective view of a roller shade according to one aspect of the embodiments.

Figure 2:
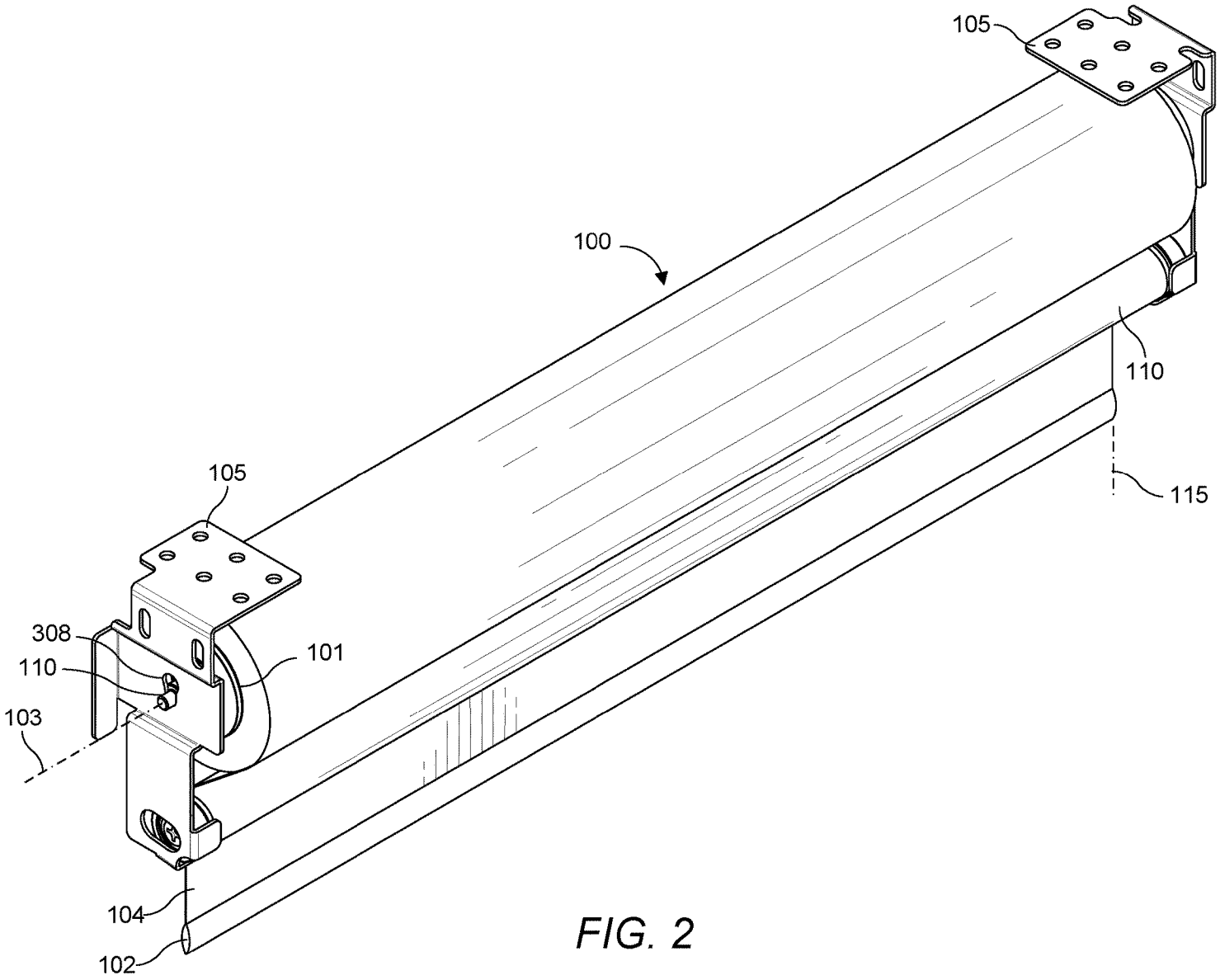

FIG. 2 illustrates a rear perspective view of the roller shade according to one aspect of the embodiments.

Figure 3C:
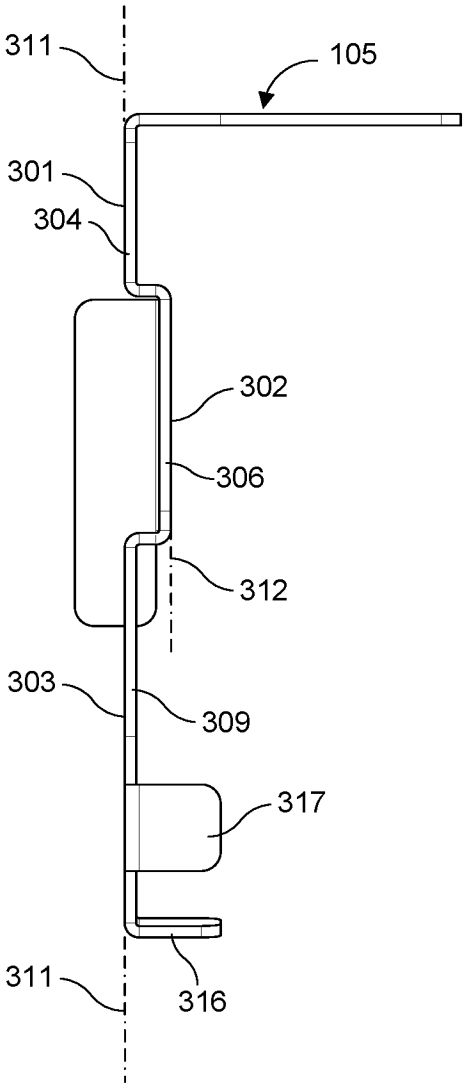
Figure 3B:
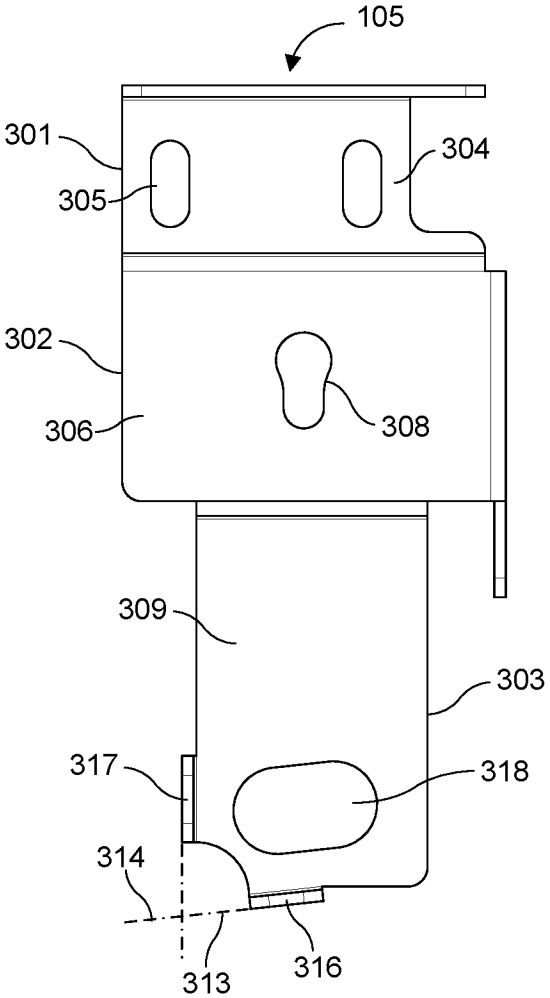
Figure 3A:
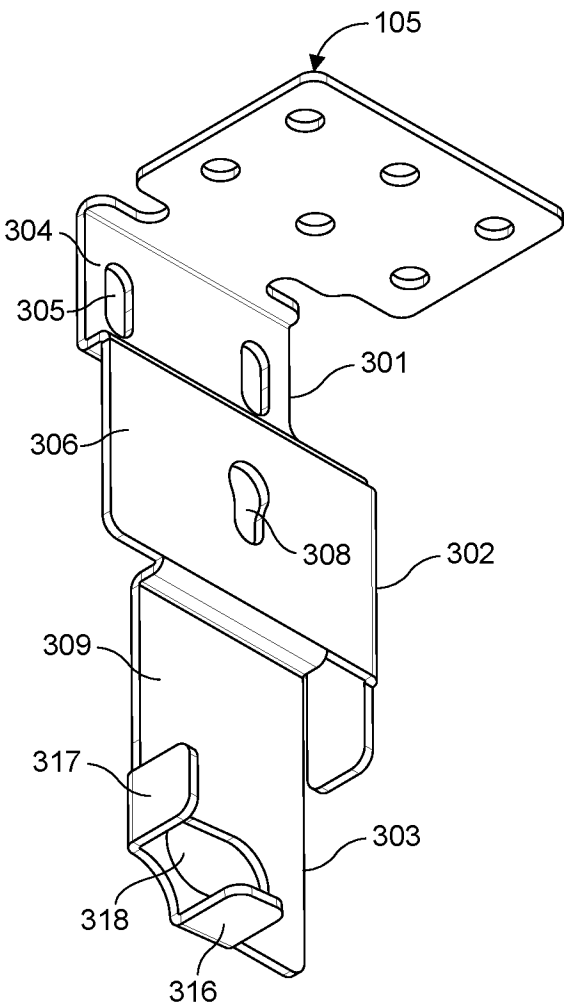

FIG. 3A illustrates a perspective rear-inner side view of a right side mounting bracket according to one aspect of the embodiments.

FIG. 3B illustrates an inner side view of the right side mounting bracket according to one aspect of the embodiments.

FIG. 3C illustrates a rear view of the right side mounting bracket according to one aspect of the embodiments.

Figure 4A:
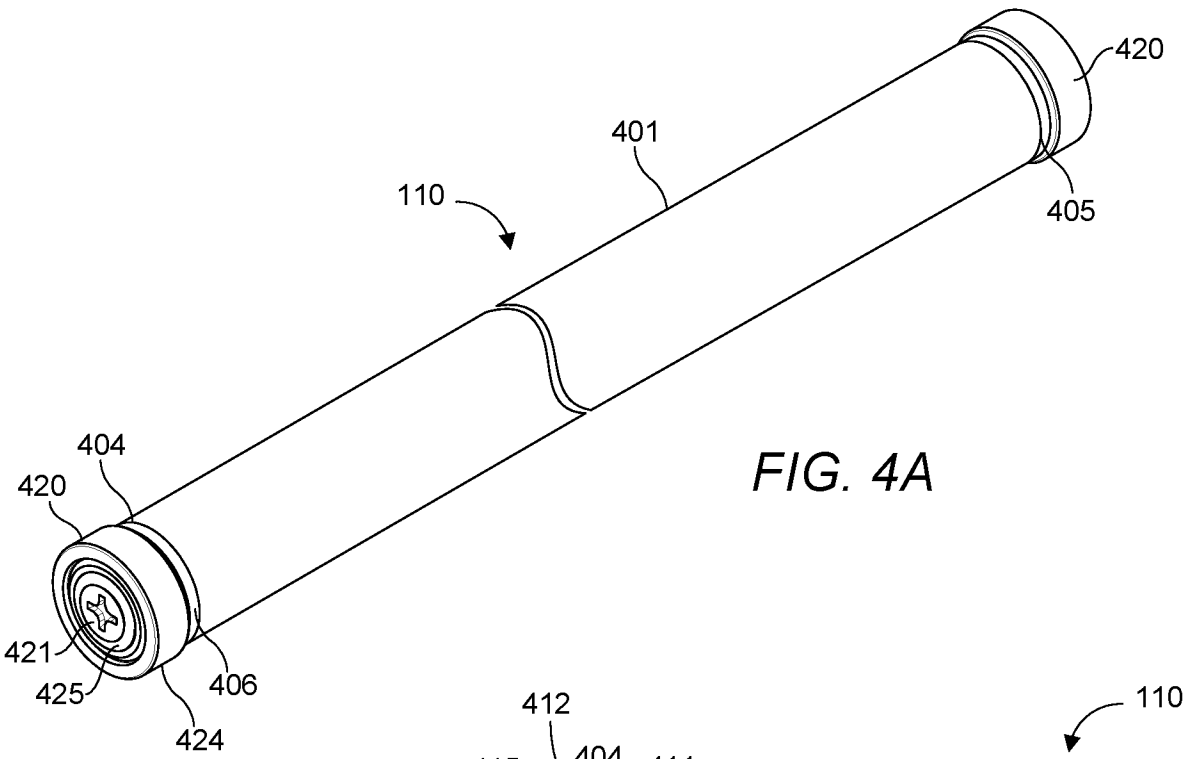

FIG. 4A illustrates a perspective view of a diverter according to one aspect of the embodiments.

Figure 4B:
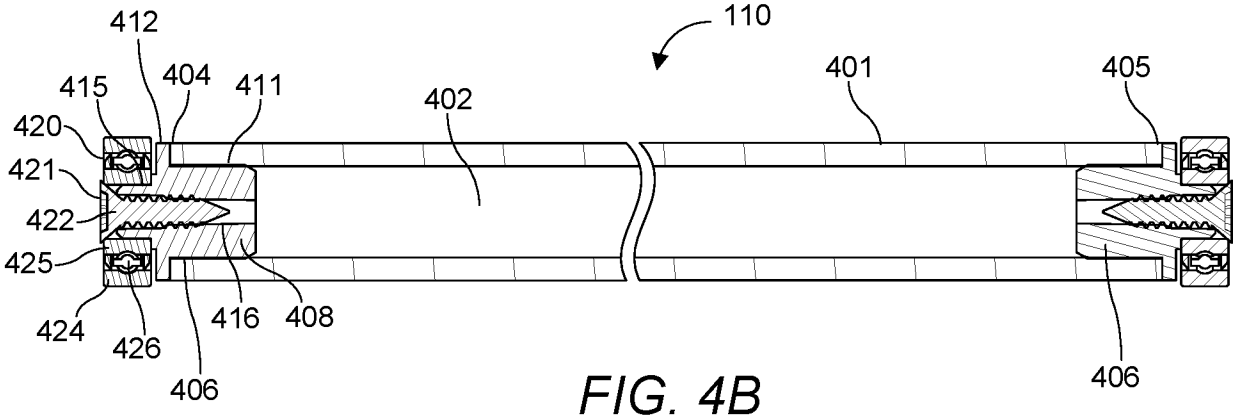

FIG. 4B illustrates a cross sectional view of the diverter according to one aspect of the embodiments.

Figure 5B:
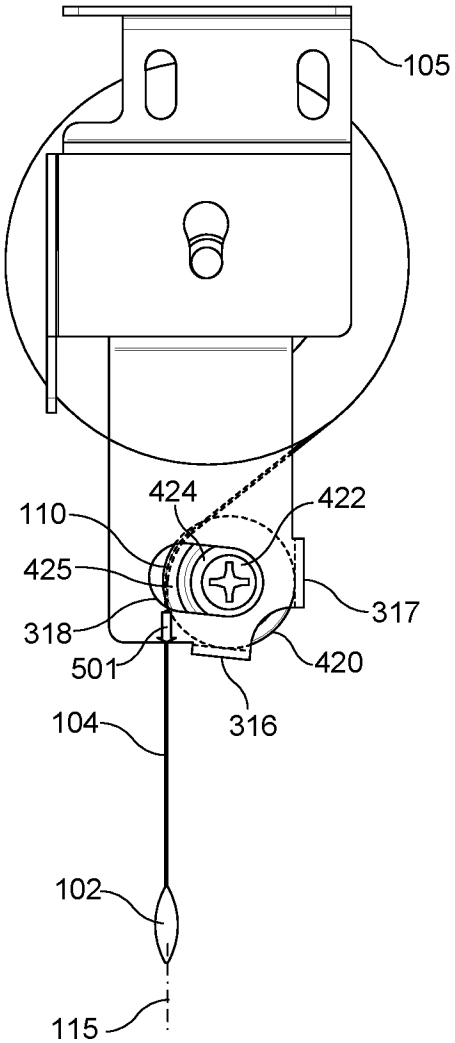
Figure 5A:
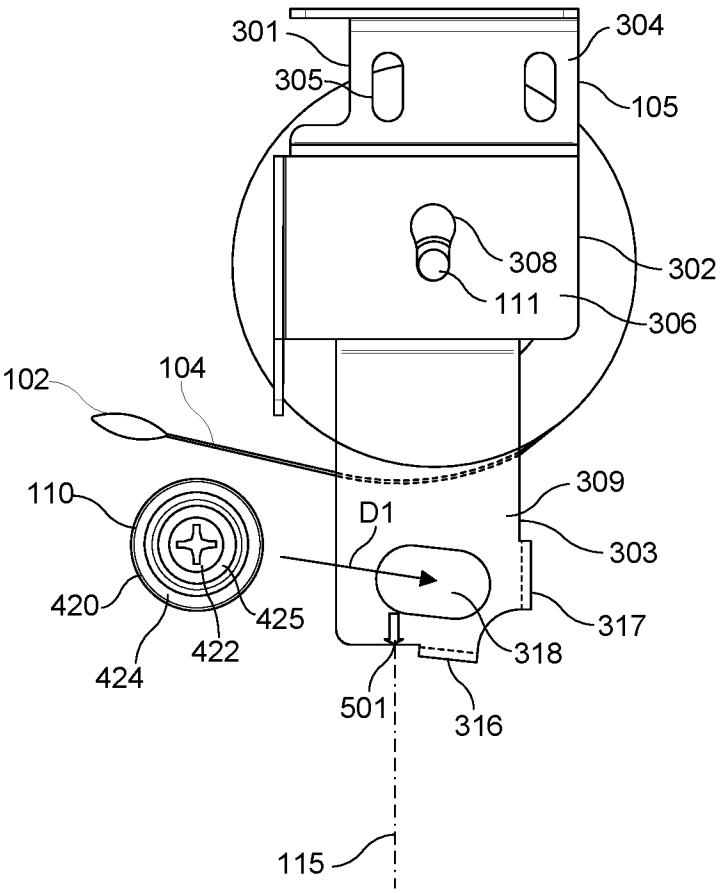

FIG. 5A illustrates an outer side view of the diverter being inserted into the mounting bracket of the roller shade according to one aspect of the embodiments.

FIG. 5B illustrated an outer side view of the diverter retained in the mounting bracket of the roller shade according to one aspect of the embodiments.

Figure 6B:
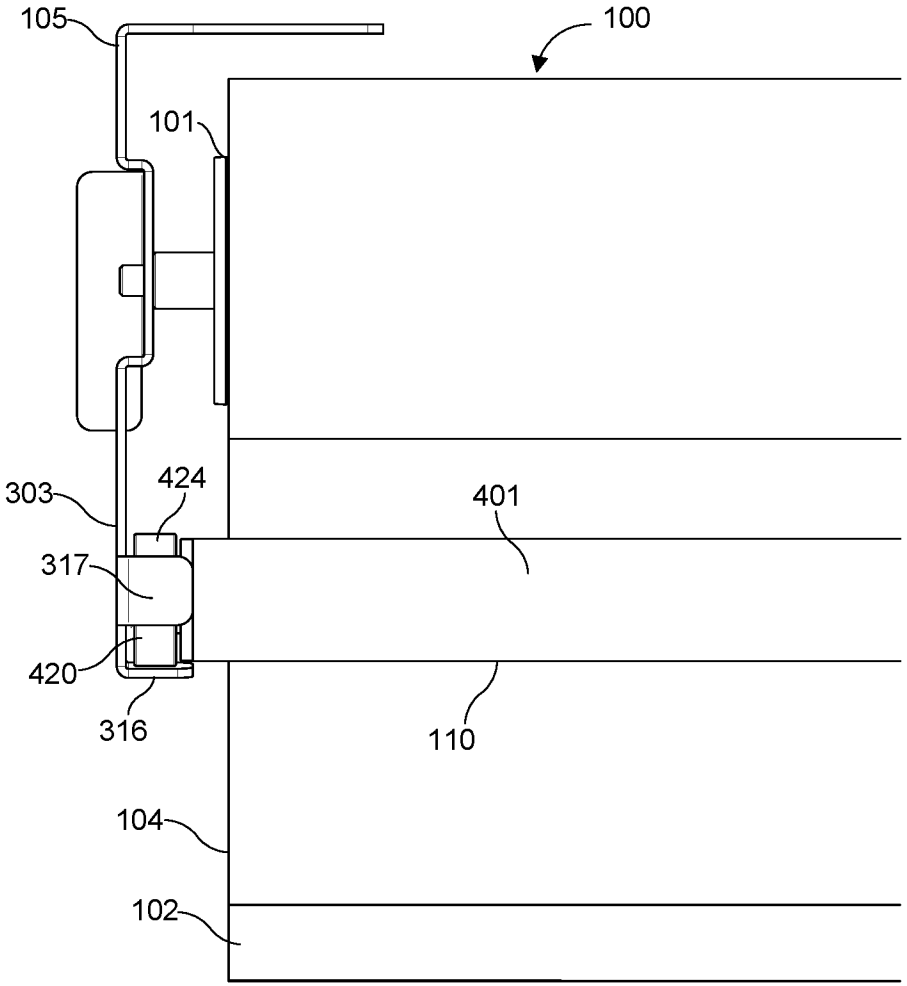
Figure 6A:
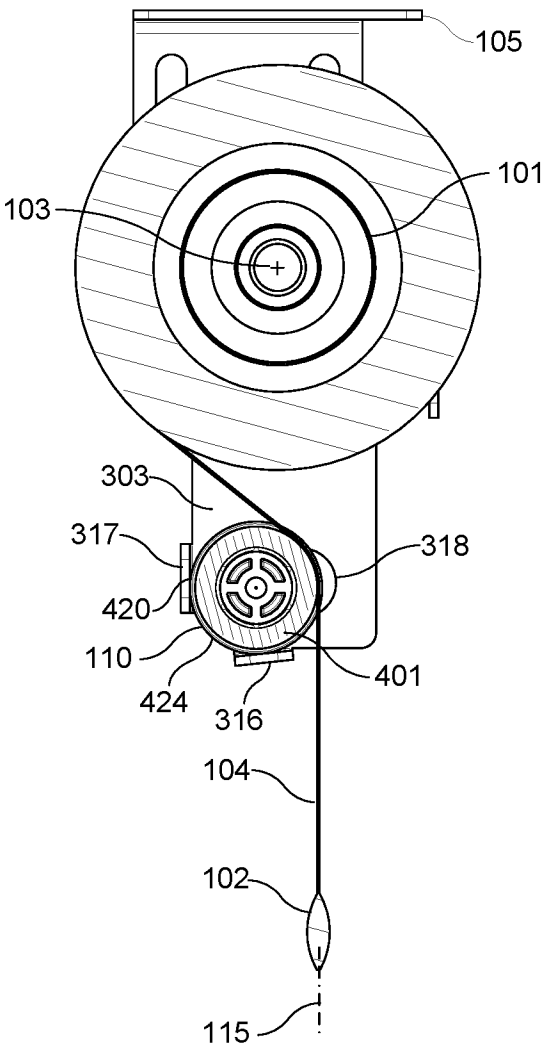

FIG. 6A illustrates an inner side view of the right side mounting bracket with cross sectional views of the roller shade and diverter according to one aspect of the embodiments.

FIG. 6B illustrates a partial rear view of the right side mounting bracket, roller shade, and diverter according to one aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Roller Tube
102 Hem Bar
103 Central Axis of Rotation
104 Shade Material
105 Mounting Brackets
110 Diverter
111 Idler Pin
115 Drop Down position
301 Structural Mounting Portion
302 Shade Mounting Portion
303 Diverter Retaining Portion
304 First Side Wall
305 Mounting Holes
306 Second Side Wall
308 Keyhole
309 Third Side Wall
311 First Plane
312 Second Plane
313 Third Plane
314 Fourth Plane
316 Bottom Wall
317 Rear Wall
318 Opening
401 Diverter Roller
402 Bore
404 First End
405 Second End
406 Bearing Hub
408 Plug
411 Teeth
412 Flange
415 Shoulder
416 Threaded Bore
420 Bearings
421 Screw
422 Screw Head
424 Outer Race
425 Inner Race
426 Balls
501 Alignment Marking

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of roller shades, but is not limited thereto, except as may be set forth expressly in the appended claims. While the roller shade is described herein for covering a window, the roller shade may be used to cover doors, wall openings, or other openings of a structure. The embodiments described herein may further be adapted in other types of window or door shades, such as inverted rollers, Roman shades, Austrian shades, pleated shades, blinds, shutters, skylight shades, garage doors, or the like.

Referring to FIGS. 1 and 2, where FIG. 1 illustrates a front perspective view of a roller shade 100 and FIG. 2 illustrates a rear perspective view of the roller shade 100, according to one embodiment. Roller shade 100 generally comprise a roller tube 101, shade material 104, and a hem bar 102. Shade material 104 is connected at its top end to the roller tube 101 and at its bottom end to the hem bar 102. The roller tube 101 may be generally cylindrical in shape extending about a central axis of rotation 103. The shade material 104 wraps around the roller tube 101 and is unraveled from the roller tube 101 to cover a window, a door, a wall opening, or other structural openings. In various embodiments, the shade material 104 comprises fabric, plastic, vinyl, or other materials known to those skilled in the art.

According to various embodiments, the shade 100 may comprise a shade drive unit adapted raise or lower the shade material 104 to open or close the structural opening, such as a window frame. The shade drive unit may be received within the roller tube 101 and may be adapted to rotate the roller tube 101 to raise or lower the shade material 104. According to one embodiment, the shade drive unit may comprise a mechanical drive assembly for manual or semi-manual operation of the shade 100, for example, allowing adjusting of the shade 100 by pulling or tugging on the hem bar 102 or by pulling on a chain. According to another embodiment, the shade drive unit may comprise a motor for motorized operation of the shade.

In a motorized implementation of the roller shade 100, the shade drive unit may include a motor control module, a motor, and a drive wheel that fit within the roller tube 101. The motor control module may comprise fully integrated electronics to control the motor, directing the operation of the motor, including its direction, speed, and position. The drive wheel may be connected to the output shaft of the motor to rotate the roller tube 101. In operation, the roller shade 100 is rolled down and rolled up via the roller shade drive unit. As a result, the shade material 104 may be lowered from an opened or rolled up position, when substantially the entire shade material 104 is wrapped about the roller tube 101, to a closed or rolled down position, when the shade material 104 is substantially unraveled.

The hem bar 102 is secured to a bottom end of the shade material 104 such that it runs longitudinally and laterally across the width of the shade material 104. The hem bar 102 may comprise a heavy material, such as steel or aluminum material, or may be weighted, to minimize any movement in the field and allow for a straight hang of the shade material 104. Accordingly, when the shade 100 is in a closed position the weighted hem bar 102 pulls down on the shade material 104 such that it hangs straight, without causing the shade material 104 to buckle or ripple. The hem bar 102 can comprise a solid or a hollow construction with a circular, oval, or other shaped cross section.

The roller shade 100 may be mounted between a pair of mounting brackets 105. Each mounting bracket 105 may be recess-mounted within a window frame via screws. In various embodiments, the roller shade 100 may be surface-mounted on a wall (e.g., in front of the frame enclosing a window), or recess-mounted in a ceiling pocket, a door frame, another type of opening, or the like.

According to the present embodiments, the brackets 105 are adapted to retain a diverter 110 that allows the shade material 104 to drop at the same fixed drop down position 115 during the entire travel of the shade material 104. Accordingly, the shade material 104 is prevented from translating laterally. According to one embodiment, the shade material 104 may drop down from substantially directly below the central axis 103 of the roller tube 101. However, the shade material may be diverted to other fixed drop down positions. Beneficially, the design of the diverter 110 of the present embodiments allows it to be easily installed into the mounting brackets 105 without any tools, after the roller shade 100 is installed into brackets 105. This simplifies the installation process and ensures minimal handling of the shade material 104, reducing risk of damage.

Referring to FIGS. 3A-3C, where FIG. 3A shows a perspective view of a right side mounting bracket 105, FIG. 3B shows an inner side view of the right side mounting bracket 105, and FIG. 3C shows a rear view of the right side mounting bracket 105, wherein the left side mounting bracket is substantially a mirror image thereof. According to an embodiment, each mounting bracket 105 may comprise a single stamped metal body. According to alternative embodiment, each mounting bracket 105 may comprise a plurality of separated or interconnected portions. The mounting bracket 105 may comprise a structural mounting portion 301 comprising a first side wall 304 disposed along a first plane 311. The first side wall 304 may comprise mounting holes 305 extending therethrough adapted to receive screws to attach the first side wall 304 against a structural surface, such as a window frame or a wall.

Each mounting bracket 105 may further comprise a shade mounting portion 302 adapted to couple one end of the roller shade 100 to the mounting bracket 105. Shade mounting portion 302 may comprise a second side wall 306 disposed along a second plane 312. The second plane 312 may be offset from the first plane 311 such that the structural mounting portion 301 protrudes farther than the shade mounting portion 302. According to an embodiment, shade mounting portion 302 may comprise a keyhole 308 for receiving an idler pin 111 extending out of an end of the roller shade 100, about which the roller tube 101 rotates. The left side mounting bracket may comprise a similar configuration for attaching to the other end of the roller shade 100. According to another embodiment, in an embodiment, in a motorized roller shade, the other end of the roller shade 100 may comprise a drive unit with an end that snaps to the left side mounting bracket or which couples to the left side mounting bracket using screws.

Each mounting bracket 105 may further comprise a diverter retaining portion 303 disposed adjacent to the shade mounting portion 302 and adapted to retain one end of the diverter 110. According to one embodiment, the diverter retaining portion 303 may be disposed directly below the shade mounting portion 302 to substantially center the fixed drop down position 115 of the shade material 104 with the central axis 103 of the roller tube 101. According to another embodiment, the diverter rotating portion 303 may be disposed in a different position or orientation with respect to the roller tube 101 to divert the shade material 104 to a different fixed drop down position and eliminate any lateral displacement during travel.

The diverter retaining portion 303 may comprise a third side wall 309, which may be disposed along the first plane 311, or another plane, offset from the second plane 312. As such, the diverter retaining portion 303 protrudes farther than the shade mounting portion 302. The diverter retaining portion 303 may comprise a bottom wall 316 extending laterally from a bottom edge of the third side wall 309 along a third plane 313, substantially orthogonal to the first plane 311. The diverter retaining portion 303 may further comprise a rear wall 317 extending laterally from a side edge of the third side wall 309 along a fourth plane 314, substantially orthogonal to the first plane 311. According to an embodiment, the third plane 313 of the bottom wall 316 may be substantially orthogonal to the fourth plane 314 of the rear wall 317, such that the bottom wall 316 and the rear wall 317 are disposed at a right angle with respect to each other. According to another embodiment, the third plane 313 of the bottom wall 316 may be disposed at slightly less than a right angle with respect to the fourth plane 314 such that the bottom wall 316 is declined towards the rear wall 317. The bottom wall 316 and rear wall 317 may be interconnected, or they may be separated forming a pair of retaining arms, as shown in FIG. 3A, for engaging an end of the diverter 110.

The diverter retaining portion 303 may further comprise an opening 318 extending through the third side wall 309. Opening 318 may comprise an oblong shape formed by a pair of oppositely disposed semicircular sides interconnected by a pair of parallel sides. The oblong opening 318 may be partially disposed between the bottom wall 316 and the rear wall 317. The oblong opening 318 may be oriented in a direction parallel to the third plane 313 such that the length of the oblong opening 318 is parallel with the bottom wall 316.

Referring to FIGS. 4A-4B, FIG. 4A illustrates a perspective view of the diverter 110 and FIG. 4B illustrates a cross sectional view of the diverter 110, according to an illustrative embodiment. The diverter 110 may comprise a diverter roller 401. The diverter roller 401 may be tubular in shape with about 1.625 inches outer diameter extending longitudinally from a first end 404 to a second end 405. The diverter roller 401 may be hollow comprising a bore 402 extending therethrough from the first end 404 to the second end 405. According to an embodiment, the diverter roller 401 may be formed from an aluminum tube extrusion, sized to minimize deflection.

According to an embodiment, the diverter 110 may further comprise a pair of bearing hubs 406, which may be formed from a molded plastic material. Each bearing hub 406 may comprise a tubular plug 408 sized to be received within the bore 402 of the diverter roller 401 through a first end 404 or the second end 405. Each plug 408 may comprise a plurality of teeth 411 extending circumferentially about the external surface of the plug 408. Teeth 411 are used to form a friction fit between the external surfaces of the plugs 408 and the inner surface of the bore 402 in the diverter roller 401. During assembly, the bearing hubs 406 may be press fitted within the bore 402. Each bearing hub 406 may further comprise a flange 412 radially extending therefrom. Flange 412 prevents the bearing hub 406 from sliding entirely into the diverter roller 401. Each bearing hub 406 may further comprise a shoulder 415 configured for receiving a bearing 420 thereon. In addition, each bearing hub 405 may comprise a threaded bore 416 longitudinally extending through its center.

The diverter 110 may further comprise a pair of bearings 420, each adapted to be received over the shoulder 415 of the bearing hub 406. According to an embodiment, each bearing 420 may comprise an outer diameter slightly larger than the outer diameter of the diverter roller 401. Each bearing 420 may generally comprise an outer race 424, an inner race 425, and a plurality of balls 426 disposed therebetween, as is well known in the art. Although other types of begins may be used, including ball bearings, roller bearings, magnetic bearing, or the like. The bearings 420 may be oil lubricated to reduce rolling resistance and shielded to provide protection from contamination. In various embodiments, the bearings 420 may each comprise aluminum or stainless steel. According to an embodiment, each bearing 420 may be retained on the bearing hub 406 via a screw 421 that is received in the threaded bore 416. Each screw 421 may comprise a screw head 422 adapted to retain the inner race 425 of the bearing 420 between the screw head 422 and the shoulder 415 in the bearing hub 406. The screw head 422 may slightly protrude from the diverter 110.

In other embodiments, the shoulder 415 of the bearing hub 406 may comprise a width adapted to receive a width of the inner race 425 of the bearing 420 and may comprise retaining clips circumferentially disposed at the end of the shoulder 415 such that the bearing 420 may snap into the shoulder 415 and retained via the retaining clips. According to further embodiments, the diverter 110 may not comprise the bearing hub 406, and instead, the diverter roller 401 may be configured to retain the pair of bearings 420. For example, the diverter roller 401 may comprise a molded plastic body with ends containing shoulders adapted to retain the bearings 420 thereon.

Referring to FIGS. 5A-5B, there is shows a method of installing the diverter 110 in the mounting bracket 105 to divert the shade material according to an illustrative embodiment. After a customer places an order, choosing a roller shade 100 and providing installation dimensions, the diverter roller 401 may be cut to size and the diverter 110 may be assembled at the same time as the roller shade 100 and shipped together with the roller shade 100. During installation, initially, the structural mounting portion 301 of the mounting bracket 105 may be secured to a structural surface using screws. According to an embodiment, the mounting bracket 105 may comprise an alignment marking 501 indicating the shade material drop down position 115. The alignment marking 501 may, for example, assist the installer to align the shade material drop down position 115 with an opening in the ceiling out of the architectural pocket to ease installation.

Then, the roller shade 100 may be secured to the shade mounting portion 302 of the mounting bracket 105. As shown in FIG. 5A, the shade material 104 may be slightly unraveled from the roller tube 101 and lifted via the hem bar 102 to expose the diverter retaining portions 303 of the mounting brackets 105. The diverter 110 may then be inserted between the mounting brackets 105 toward the diverter retaining portions 303 in direction D1 and aligned such that each screw head 422 at the end of the diverter 110 is retained within a respective opening 318 in a respective diverter retaining portion 303. The oblong shape of the openings 318 provide a relief to allow diverter 110 to be slightly tilted to align the screw heads 422 with the openings 318. The diverter 110 can then be further inserted into the diverter retaining portions 303 direction D1 until each bearing 420 rests between a respective bottom wall 316 and rear wall 317 of the respective diverter retaining portion 303. The shade material 104 may then be released to rest on the diverter roller 401 as shown in FIG. 5B. Beneficially, the installation of the diverter 110 is quick and simple and does not require any tools.

As an alternative embodiment to screws 421, the ends of the diverter 110 may comprise pins biased in an outward direction using springs. The openings 318 may comprise a circular shape sized to receive the pins. During installation, the pins may be deflected to allow the diverter 110 to be inserted between the mounting brackets 105. The pins of the diverter 110 may then be aligned with the openings 318 allowing the pins to extend into the openings 318 via the force exerted by the springs.

Referring to FIGS. 6A and 6B, where FIG. 6A shows an inner side view of the right side mounting bracket 105 with cross sectional views of the roller shade 100 and diverter 110, and FIG. 6B illustrates a partial rear view of the right side mounting bracket 105, roller shade 100, and diverter 110. The outer race 424 of the bearings 420 rests on the bottom wall 316 as well as the rear wall 317 of the diverter retaining portion 303. The decline of the bottom wall 316 forces the diverter 110 to abut and rest against the rear wall 317 via gravity, further assisting the diverter 110 to be retained by the diverter retaining portion 303. However, as stated above, the bottom wall 316 may be at a right angle with the rear wall 317. In such configuration, the lateral force of the shade material 104 in combination with the weight of the hem bar 102 exerted on the diverter roller 401 retains the diverter 110 between the bottom wall 316 and the rear wall 317 of the diverter retaining portion 303.

As shown in FIG. 6B, the diverter 110 comprises a length larger than the roller tube 100 of the roller shade 100 such that the bearings 420 protrude farther than the roller tube 101. As such, as the bearings 420 rest on the diverter retaining portions 303 of the mounting brackets 105, the shade material 104 rests on the diverter roller 401. In addition, each bearing 420 comprises an outer diameter slightly larger than the outer diameter of the diverter roller 401 such that the diverter roller 401 does not come into contact with the bottom wall 316 or rear wall 317 of the diverter retaining portion 303. The diverter roller 401 may thereby freely rotate about its axis via the bearings 420.

As the shade material 104 is raised and lowered, the upward or downward displacement of the shade material 104 will rotate the diverter roller 401 with respect to the diverter retaining portion 303 via the bearings 420. Beneficially, the bearings 420 ensure that the diverter roller 401 will roll on the shade material 104, instead of sliding on the shade material 104, which may cause damage to the shade material 104. In addition, the bearings 420 attached to the ends of the diverter roller 401 ensure that there is next to no friction and no additional torque required from the roller drive unit of the roller shade 100 to raise or lower the shade 100.

INDUSTRIAL APPLICABILITY

The disclosed embodiments provide systems, methods, and modes for a shade bracket and diverter. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

ALTERNATE EMBODIMENTS

Alternate embodiments may be devised without departing from the spirit or the scope of the different aspects of the embodiments.

What is claimed is:

1. A roller shade having a diverter assembly comprising:

a roller tube;

a shade material attached to the roller tube;

a shade drive unit adapted to rotate the roller tube to raise or lower the shade material;

a pair of mounting brackets adapted to secure to a structure and retain the roller tube therebetween, wherein each mounting bracket comprises a diverter retaining portion comprising a vertical side wall, a bottom wall and a rear wall laterally extending from the vertical side wall, and an oblong opening extending through the vertical side wall and at least partially between the bottom wall and the rear wall, wherein the bottom wall is declined towards the rear wall, and wherein the oblong opening longitudinally extends parallel to the bottom wall; and a diverter comprises a diverter roller, a pair of bearings disposed on two opposite ends of the diverter roller, and a pair of protruding members extending from the opposite ends of the diverter roller, wherein each bearing comprises an inner race secured on one of the opposite ends of the diverter roller and an outer race rotatably attached to the inner race via a friction reducing member;

wherein the diverter is removably retained between the pair of mounting brackets whereby each protruding member of the diverter is received within the oblong opening of the respective diverter retaining portion and whereby each outer race of the respective bearing is engaged between the bottom wall and the rear wall of the respective diverter retaining portion such that the diverter roller to freely rotates with respect to the diverter retaining portions via the bearings;

wherein the diverter roller is adapted to divert the shade material to a fixed drop down position.

2. The roller shade of claim 1, wherein each mounting bracket comprises a structural mounting portion adapted to secure the mounting bracket to the structure.

3. The roller shade of claim 1, wherein the bottom wall and the rear wall are separated forming a pair of retaining arms.

4. The roller shade of claim 1, wherein each bearing comprises at least one selected from the group consisting of a ball bearing, a roller bearing, and a magnetic bearing.

5. The roller shade of claim 1, wherein each protruding member comprises a screw.

6. The roller shade of claim 1, wherein as the shade material is raised or lowered, the shade material rotates the diverter roller with respect to the diverter retaining portion via the bearings such that the diverter roller rolls on the shade material.

7. The roller shade of claim 1, wherein each mounting bracket comprises a shade mounting portion adapted to couple one end of the roller tube shade to the mounting bracket.

8. The roller shade of claim 7, wherein the diverter retaining portion extends along a first plane and wherein the shade mounting portion extends along a second plane, which is offset from the first plane such that the diverter retaining portion protrudes farther than the shade mounting portion.

9. The roller shade of claim 7, wherein the diverter retaining portion is disposed directly below the shade mounting portion to substantially center the fixed drop down position of the shade material with a center of the roller shade.

10. The roller shade of claim 7, wherein the diverter retaining portion is offset from the shade mounting portion to offset the fixed drop down position from the center of the roller shade.

11. The roller shade of claim 1, wherein the diverter further comprises a pair of bearing hubs attached to the opposite ends of the diverter roller and each adapted to retain one of the bearings.

12. The roller shade of claim 11, wherein each bearing hub comprises a plug sized to be press fitted in a bore longitudinally extending within the diverter roller.

13. The roller shade of claim 11, wherein each bearing hub comprises a shoulder adapted to receive one of the inner races of the bearings thereon.

14. The roller shade of claim 13, wherein each protruding member comprises a screw, wherein each bearing hub comprises a threaded bore adapted to receive the screw therein, wherein the inner race of the bearing is retained on the shoulder via a head of the screw.

15. A method for diverting a shade material of a roller shade to a fixed drop down position, wherein the roller shade comprises a roller tube, the shade material attached to the roller tube, and a shade drive unit adapted to rotate the roller tube to raise or lower the shade material, wherein the method comprising the steps of:

securing a pair of mounting brackets to a surface of a structure;

installing the roller tube between the pair of mounting brackets, wherein each mounting bracket comprises a diverter retaining portion comprising a vertical side wall, a bottom wall and a rear wall laterally extending from the vertical side wall, and an oblong opening extending through the vertical side wall and at least partially between the bottom wall and the rear wall, wherein the bottom wall is declined towards the rear wall, and wherein the oblong opening longitudinally extends parallel to the bottom wall;

inserting a diverter between the mounting brackets, wherein the diverter comprises a diverter roller, a pair of bearings disposed on two opposite ends of the diverter roller, and a pair of protruding members extending from the opposite ends of the diverter roller, wherein each bearing comprises an inner race secured on one of the opposite ends of the diverter roller and an outer race rotatably attached to the inner race via a friction reducing member;

inserting each protruding member of the diverter into the oblong opening of the respective diverter retaining portion;

resting each outer race of the respective bearing of the diverter between the bottom wall and the rear wall of the respective diverter retaining portion; and resting the shade material on the diverter roller, wherein as the shade material is raised or lowered the diverter roller freely rotates with respect to the diverter retaining portion via the bearings and rolls on the shade material.

* * * * *